US006304662B1

(12) United States Patent
Norris et al.

(10) Patent No.: US 6,304,662 B1
(45) Date of Patent: Oct. 16, 2001

(54) SONIC EMITTER WITH FOAM STATOR

(75) Inventors: Elwood G. Norris; James J. Croft, III, both of Poway, CA (US)

(73) Assignee: American Technology Corporation, San Diego, CA (US)

( * ) Notice: Subject to any disclaimer, the term of this patent is extended or adjusted under 35 U.S.C. 154(b) by 0 days.

(21) Appl. No.: 09/004,090

(22) Filed: Jan. 7, 1998

(51) Int. Cl.[7] ..... H04R 25/00
(52) U.S. Cl. ..... 381/191; 381/174
(58) Field of Search ..... 381/190, 191, 381/174, 111, 113, 116; 367/170, 181

(56) References Cited

U.S. PATENT DOCUMENTS

| | | | |
|---|---|---|---|
| 1,799,053 | 3/1931 | Mache . | |
| 1,809,754 | 6/1931 | Steedle . | |
| 1,983,377 | 12/1934 | Kellogg . | |
| 2,855,467 | 10/1958 | Curry . | |
| 2,872,532 | 2/1959 | Buchmann . | |
| 2,935,575 | 5/1960 | Bobb . | |
| 2,975,243 | 3/1961 | Katella . | |
| 3,008,013 | 11/1961 | Williamson et al. . | |
| 3,136,867 | 6/1964 | Brettell . | |
| 3,345,469 | 10/1967 | Rod . | |
| 3,373,251 | 3/1968 | Seeler . | |
| 3,389,226 | 6/1968 | Peabody . | |
| 3,544,733 | 12/1970 | Reylek . | |
| 3,654,403 | 4/1972 | Bobb . | |
| 3,674,946 | 7/1972 | Winey . | |
| 3,787,642 | 1/1974 | Young, Jr. . | |
| 3,821,490 | 6/1974 | Bobb . | |
| 3,829,623 | 8/1974 | Willis . | |
| 3,833,771 | 9/1974 | Collinson . | |
| 3,892,927 | 7/1975 | Lindenberg . | |
| 3,919,499 | 11/1975 | Winey . | |
| 3,941,946 | 3/1976 | Kawakami . | |
| 3,997,739 | 12/1976 | Kishikawa . | |
| 4,160,882 | 7/1979 | Driver . | |
| 4,210,786 | 7/1980 | Winey . | |
| 4,289,936 | 9/1981 | Civitello . | |
| 4,385,210 | 5/1983 | Marquiss . | |
| 4,419,545 | 12/1983 | Kuindersma . | |
| 4,434,327 * | 2/1984 | Busch-Vishniac et al. | 381/191 |
| 4,471,172 | 9/1984 | Winey . | |
| 4,480,155 | 10/1984 | Winey . | |
| 4,550,228 | 10/1985 | Walker et al. . | |
| 4,593,160 | 6/1986 | Nakamura . | |
| 4,803,733 | 2/1989 | Carver et al. . | |
| 4,885,781 | 12/1989 | Seidel . | |
| 4,939,784 | 7/1990 | Bruney . | |
| 5,054,081 | 10/1991 | West . | |
| 5,392,358 | 2/1995 | Driver . | |
| 5,430,805 | 7/1995 | Stevenson et al. . | |
| 6,011,855 * | 1/2000 | Selfridge et al. | 381/111 |

OTHER PUBLICATIONS

Crandall, I.B. *Air–Damped Vibrating System: Theoretical Calibration of the Condenser Transmitter*, Phys. Rev., vol 11 (1918) pp. 449–460.

* cited by examiner

*Primary Examiner*—Huyen Le
(74) *Attorney, Agent, or Firm*—Thorpe North & Western, LLP

(57) ABSTRACT

A speaker device comprising an electrostatic emitter film which is responsive to an applied variable voltage to emit sonic output based on a desired sonic signal, used in combination with at least a first foam member having a forward face, an intermediate core section and a rear face. The forward face is composed of a composition having sufficient stiffness to support the electrostatic film and includes conductive properties which enable application of a variable voltage to supply the desired sonic signal. The surface of the forward face includes small cavities having surrounding wall structure defining each cavity which terminates at contacting edges approximately coincident with the forward face of the foam member. The film is applied to the forward face of the foam member and biased in direct contact with the contacting edges of the forward face.

22 Claims, 5 Drawing Sheets

SONIC EMITTER WITH FOAM STATOR

BACKGROUND OF THE INVENTION

1. Field of the Invention

The present invention relates to capacitive or electrostatic sonic emitters and more particularly to emitters which include a stator element and associated, movable emitter film useful for generating sonic output as a speaker device in response to an applied variable voltage.

2. Prior Art

The science of acoustics has long known of the utility of a movable electrostatic membrane or film associated with and insulated from a stator or driver member part of as a speaker and/or microphone device. Typical construction of such devices includes a flexible Mylar(tm) or Kapton(tm) film having a metalized coating and an associated conductive, rigid plate which are separated by an air gap or insulative material. An applied voltage including a sonic signal is transmitted to this capacitive assembly and operates to displace the flexible emitter film to propagate the desired sonic compression wave.

Two primary categories of electrostatic speakers exists, depending on the application and frequency of the sonic output. Single-ended speakers comprise a single plate, typically having holes to allow the sound to pass through. The film is suspended in front or behind the plate, and may be displaced out of contact with the plate by spacers. With ultrasonic emitters, the film has been biased in direct contact with an irregular face of the plate, whereby the film is allowed to vibrate in pockets or cavities. An insulative barrier of either air, plastic film or similar nonconductive material is sandwiched between the film and plate to prevent electrical contact and arcing. Typically, the plate and diaphragm are coupled to a dc power supply to establish opposing polarity at the respective conducting surfaces of the metalized coating and the plate. The capacitive relationship resulting from this configuration enables the electrostatic speaker to convert a variable voltage into sonic output as a compression wave.

The second primary category of electrostatic speakers is represented by the push-pull configuration. In this case, the speaker has two rigid plates which are symmetrically displaced on each side of a conductive membrane. With applied voltage, one plate becomes negative with respect to the membrane while the opposing plate assumes a positive charge. The transmission of a variable voltage to this capacitive assembly results in the reinforcing effects of push and pull on the membrane, thereby enhancing power output. Further details of theory and construction of common electrostatic emitter designs is found in *Electrostatic Loudspeaker* by Ronald Wagner, Audio Amateur Press, 1993.

Many years of directed research have developed a variety of technical improvements to this basic system, but the component definition has remained substantially the same. In particular, the rigid plate which operates as the stator or static element generally provides support to the film and supplies a conductive medium for application of the desired sonic signal. Typical materials used for plate construction include aluminum, copper plated circuit board, and similar materials well known in the art.

Although this pattern of material choice has generally served the purposes required for electrostatic speaker, the absence of substitute compositions has limited the variation in speaker applications. For example, audio systems are usually large in size to accommodate development of lower frequencies. Therefore, weight and geometric configuration become significant design factors. Furthermore, the requirement for rigidity and the known stiffness of accepted plate materials typically results in construction of the plate element as the load-bearing component of the speaker system. Taken together, the traditional limitations adopted by this history of plate development has diverted attention from exploring other options for electrostatic speaker design.

OBJECTS AND SUMMARY OF THE INVENTION

It is an object of the present invention to provide alternate component materials to the generic electrostatic speaker configuration which offer new variations in structural and acoustic properties.

It is a further object of this invention to enable reduction in weight and stiffness requirements by utilizing a foam material as the stator element of the speaker system.

Yet another object of this invention is to develop a variety of plate or stator compositions which offer selective degrees of sound transmittance based on open/closed cell structure.

A still further object of the present invention is to provide a plate or support member capable of operating in single or push-pull configuration, and within the full range of sonic output, including both audio and ultrasonic frequencies.

Another object of this invention is to provide an inexpensive foam stator or plate which has little weight and is capable of being formed in a variety of geometric configurations which offer both economy and performance enhancement.

A specific object of the present invention is to provide an electrostatic speaker for audio applications which offers substantial reductions in manufacturing costs and simplified structural design.

These and other objects are realized in a speaker device comprising an electrostatic emitter film which is responsive to an applied variable voltage to emit sonic output based on a desired sonic signal and a first foam member having a forward face, an intermediate core section and a rear face. The forward face is composed of a composition having sufficient stiffness to support the electrostatic film and conductive properties which enable application of a variable voltage to supply the desired sonic signal. The surface of the forward face includes small cavities having surrounding wall structure defining each cavity which terminates at contacting edges approximately coincident with the forward face of the foam member. The film is applied to the forward face of the foam member and biased in direct contact with the contacting edges of the forward face such that the film is directly supported by the forward face. A signal source is coupled to the speaker device for supplying the variable voltage which includes a sonic signal The invention can also be configured with the first forward face as an insulating member, with the intermediate core and /or rear face operable as the conductive element.

In another embodiment of this invention, a push-pull configuration is developed, using a second foam member of similar construction positioned on an opposing side of the electrostatic emitter film from the first foam member. The electrostatic emitter film is sandwiched between the respective foam members and includes a conductive layer in noncontacting relationship with the respective first and second foam members for enabling the film to capacitively respond with the first and second forward faces to the variable voltage in a push-pull relationship.

Another variation of this invention includes an electrostatic emitter film operable in the, audio range with a support member having a forward face, an intermediate core section and a rear face, wherein the forward face is composed of a composition having sufficient stiffness to support the electrostatic film and includes conductive properties which enable application of a variable voltage to supply the desired audio signal. The electrostatic film is applied to the forward face of the support member and is biased in direct contact with the contacting edges. Here again, the system may be adapted for push-pull operation with a second support member, and can also be modified to have the insulative layer interchanged at the forward face.

An additional embodiment of this invention comprises an electrostatic emitter film which is responsive to an applied variable voltage to emit sonic output and a first foam member having a forward face, an intermediate core section and a rear face. The foam member is again composed of a composition including conductive properties which enable application of a variable voltage to supply the desired sonic signal from the foam member to the emitter film. The forward face includes small cavities having surrounding wall structure defining each cavity, wherein the surrounding wall structure terminates approximately coincident with the forward face of the foam member. Film support means is provided for positioning and displacing the electrostatic film forward of the foam member at a distance within range of electromotive forces developed within the foam member by the variable voltage. Push-pull operation can be accomplished by adding a second foam member in comparable orientation on an opposing side of the film.

The invention also includes a method for propagating sonic energy, comprising the steps of a) selecting a foam member having a forward face small cavities defined by surrounding wall structure which includes conductive properties enabling application of a variable voltage to the forward face to supply the desired sonic signal; b) applying to the forward face of the foam member an electrostatic emitter film which is responsive to the applied variable voltage to emit sonic output based on the desired sonic signal; c) biasing the film with respect to the forward face such that the film is responsive to the variable voltage of the foam member as an electrostatic emitter, d) supplying the variable voltage to the combination of foam member and emitter; and e) propagating sonic compression waves from the emitter into surrounding air.

Other objects and features of the present invention will be apparent to those skilled in the art, based on the following detailed description, taken in combination with the accompanying drawings.

DESCRIPTION OF PREFERRED EMBODIMENTS

The preferred embodiments which are disclosed hereafter are provided as illustrations of several inventive concepts which are set forth in the attendant claims. It will be appreciated by those skilled in the art that many variations are possible, and that the drawings and examples provided herein are intended to enable one of ordinary skill in the art to apply these inventive concepts within many different speaker configurations, as well as other devices for propagating sonic energy. Accordingly, it is to be understood that the description that follows is not to be construed as limiting, except as defined in the attendant claims.

Figure 1:
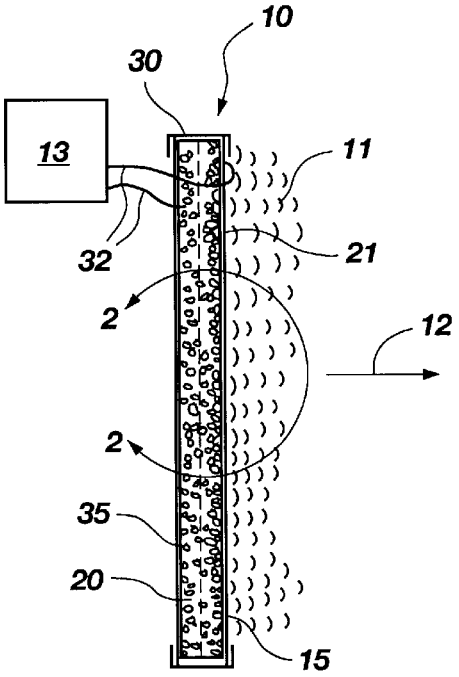
FIG. 1 depicts a cross-sectional side view of a single-end electrostatic speaker constructed in accordance with the present invention.
Figure 2:
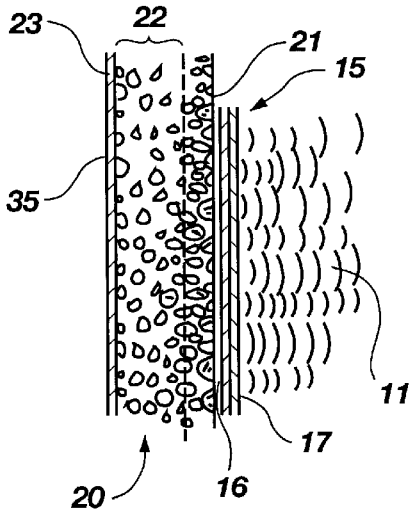
FIG. 2 is a sectional cross-section taken along the lines 2—2 of FIG. 1.

For example, FIGS. 1 and 2 show a single-end speaker device 10 with sonic output 11 being propagated in a forward direction 12. This speaker may be coupled to an audio amplifier or ultrasonic driver 13 which provides the various electronic circuitry support elements for applying a desired sonic signal. Such circuitry is well known and will not be described in any detail. The amplifier or driver 13 is merely representative of any number of signal sources including conventional radio, TV, recording, or other sound systems.

The device includes an electrostatic emitter film 15 which is responsive to an applied variable voltage to emit sonic output based on the desired sonic signal. As is shown in FIGS. 2, the emitter film comprises a plastic sheet 16 and thin metallic coating 17 or other conductive surface. Electrostatic emitter films are also well known, having been applied to many capacitive or stratified charge systems which will be generally referred to hereafter as electrostatic devices;. Typically, the plastic sheet is a Mylar(tm), Kapton (tm) or other nonconductive composition which can serve as an insulator between the metal layer 17 and a stator member 20. A surface or coating having partial conductivity may used to develop charge distribution uniformly across the diaphragm surface. A preferred range of resistivity is greater than 10 k ohms. This provides less charge migration and prevents static buildup leading to arcing. A higher impedance such as 100 Meg ohm is not uncommon in this application. Obviously, this selection also affects the capacitance between two plates.

The properties of the emitter film include flexibility, appropriate resistivity and tensile strength, all of which are again well developed in conventional electrostatic speaker technology. Any emitter film combination which has been useful in the prior art systems would likely offer some level of operability in the novel applications under the present invention. It is important in some embodiments that the emitter be able to conform to the pocketed surface of the foam to enable isolation of the various sectors at each cavity.

This is not to suggest that emitter vibration is limited to just the space captured by each cavity, however, because fringe influence and cross vibration between cavities may account for the surprising efficiency of this combination as an audio speaker.

One of the primary features of the present invention involves the use of a foam member as the stator 20. The stator serves as a base member or rigid component which offers inertia with respect to the light, flexible emitter film 15. This stator is a conductive element which supplies one polarity to the capacitor combination. Resistivity of this component is selected to favor a uniform charge migration to avoid arcing and other adverse effects inherent in electrostatic systems. A preferred composition which has demonstrated effective properties is conventional static packing foam (generally known as "conductive foam") used as packing material with computers and other charge sensitive contents. This material operates to provide static discharge away from sensitive components. It not only protects the components from adverse electrical discharge or exposure, but is very light weight and inexpensive. It is typically formed in a conventional foam molding device in virtually any shape, density, or dimension.

Prior art use of the material has generally been limited to a passive role (packing material) whose purpose is merely to protect sensitive components. Like other packing material, utility was based on temporary placement for filling space within a carton or container. Often, this material is discarded with the container as having no independent value. Its presence within the electronics market has been taken for granted and is evidenced by massive quantities in landfill throughout the world.

The present inventors have discovered an unusual and unexpected combination of properties which collectively provide effective performance as the stator element in an electrostatic speaker system. The advantages of this material will become more apparent throughout this disclosure; however, it will be immediately apparent that the potential for such inexpensive material to be part of heretofore complex and expensive electrostatic speaker systems can offer cost savings and greater access to the public market. Prior art electrostatic speaker systems are known to be very sensitive to movement, large in dimension, cumbersome in size and weight, and generally more expensive than sister sonic technologies. The use of light weight "packing" foam as a primary component of a speaker favorably impacts each of these factors, and pens a new horizon of applications for electrostatic speaker technology.

The drawings illustrate a foam composition of random pockets or cavities. Use of available technology also permits more uniform sizing of voids within the plastic matrix. Therefore, the stator component may be tuned or optimized for specific frequency applications, resonances, and related properties. Stiffness or rigidity of the foam will be a function of material properties, as well as pocket density and wall thickness defining the respective voids or pockets. Accordingly, further control of stator acoustic response can be controlled by variations in numerous physical parameters, in addition to control of random versus uniform void sizing. The importance of rigidity within the stator element is well known, and can now be partially affected by new design factors associated with the uniqueness of a foam composition.

The foam member 20 is divided conceptually into three segments, merely for the sake of discussion. Although multiple foam materials and sections may be physically structured, this representation is applied to a uniform, single composition as well. Specifically, the foam stator member includes a forward face 21, an intermediate core section 22 and a rear face 23. The various functions described hereafter may be performed by one or more of these sections in a manner which will be apparent to those skilled in the art.

For example, any one or all of these sections may be composed of a composition having sufficient stiffness to support the electrostatic film as part of the speaker system. Furthermore, one or more of these sections may include conductive properties which enable application of a variable voltage for driving the emitter diaphragm or film. FIG. 1 illustrates the use of a single composition having the required stiffness and conductivity; however, these properties could also be limited to the forward face as well, depending upon the needs of a particular speaker system. Similarly, the conductive property could be limited to the intermediate and/or rear face, particularly in later embodiments wherein the forward face operates as an insulator.

Figure 3:
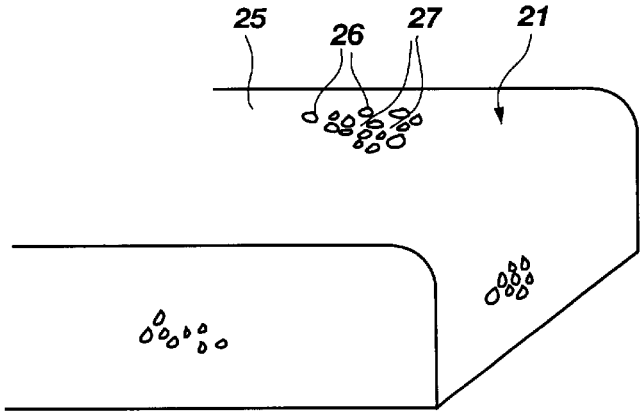
FIG. 3 graphically illustrates an elevated, perspective view of a section of a foam stator wherein cavities and features have been isolated for explanation purposes.

Referring again to the drawings, and specifically to FIG. 3, the forward face 21 comprises a surface 25 including small cavities 26 having surrounding wall structure 27 defining each cavity. The surrounding wall structure terminates at contacting edges approximately coincident with the forward face of the foam member. Here again, the sizes and configurations of these features 25, 26, and 27 may be selectively formed to optimize desired properties of the system. Where uniform properties are desired, a tooled mold can be used to precisely form the forward face structure as desired.

The emitter film and stator are joined by film application means 30 such as a frame, clamp or brace for applying the electrostatic film to the forward face of the foam member. In this embodiment of FIG. 1, the film is in direct contact with the forward face. Accordingly, the conductive elements are the foam and metallic coating, whereas the plastic film provides proper insulation there between. A biasing means may alternatively be used for biasing the film in direct contact with the contacting edges of the forward face such that the film is directly supported by the forward face. This biasing means may be an applied voltage from the circuitry 13, or by independent source, including mechanical means. Wires 32 or other coupling means are provided for coupling the signal source 13 to the speaker device for supplying the variable voltage which includes a sonic signal. Despite the simplicity and inexpensive character of this foam and film combination, it is possible to develop a high quality sonic output 11. This may be either audio or ultrasonic.

Figure 4:
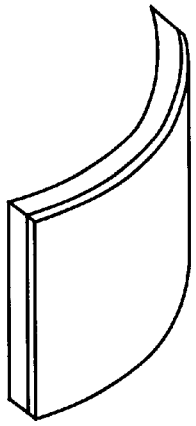
FIG. 4 depicts an arcuate shape representing a possible configuration for the present speaker device.
Figure 5:
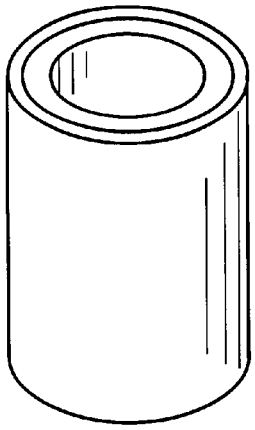
FIG. 5 depicts a cylindrical shape representing a possible configuration for the present speaker device.
Figure 6:
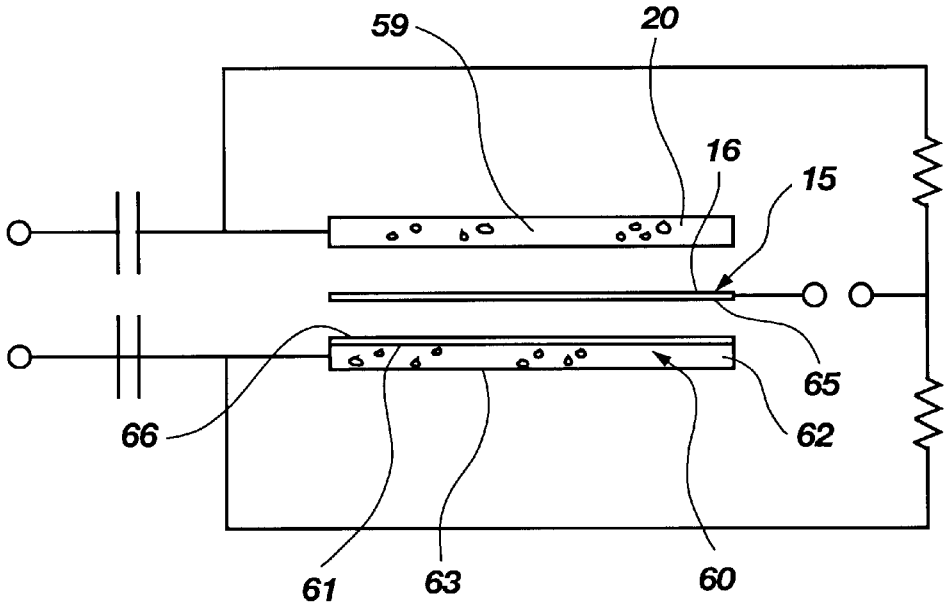
FIG. 6 provides a schematic representation of a basic form of the present speaker device in push-pull configuration.

Although the foam member illustrated comprises an open cell structure, a combination of open and closed cell structure is also available. The advantage of open cell structure is bidirectional propagation of sound. This bidirectional aspect has been dampened in the FIG. 1 embodiment by attachment of a nonporous membrane 35 on the rear face of the foam member. This membrane may also be replaced by a stiffening member formed of plastic or some other rigid material. The stiffening member may attached to conform to a desired speaker configuration. For example, conventional electrostatic speaker are usually planar because the diaphragm is not in contact with the stator, but is suspended in front of the stator. It is therefore difficult to bend the diaphragm in a curved path without distorting the gap between the stator and film. With the present invention having direct contact of the emitter film on the face of the foam, however, a curved configuration is as simple to form as a planar shape. Indeed, the curved surface offers a desirable resistance against the film which performs part of the biasing function for enhancing contact The ability to mold virtually any form or shape with foam permits equal latitude in configuring various shapes for the speaker face. For example, the speaker may be a curved surface as shown in FIG. 4, providing improved dispersion of sound propagation; or it can be circumferential as with a cylinder (FIG. 5) and a sphere (FIG. 6). Each of these embodiments offers unique dispersion patterns which have been very difficult to incorporate within electrostatic speaker systems, particularly for audio output.

In addition to the structural benefits of the present foam emitter, the contacting relationship between the forward face and the emitter film provide significant power advantages. It is well known that the electrostatic force applied to the emitter membrane falls off by the square of the separating distance. Conventional audio speakers are specifically designed with a gap between the stator and diaphragm for enabling diaphragm displacement as the audio signal develops across the speaker face. This displacement necessarily weakens the field strength as indicated.

In the present invention, the exposed foam cells or cavities provide part of the vibrating sector for the emitter film. At the contacting edges of the forward face, the gap is at a minimum-basically the thickness of the Mylar or plastic film component. Each surrounding cavity however experiences the field effects of the applied voltage at ranges which are near zero, to longer distance extending to the depth of the cavity. In other words, the contacting emitter film develops a range of field effect that includes "fringe charge" surrounding each cavity. This fringe change is carried on the surrounding cell wall, which is usually very thin. The surprising result is that the present invention becomes an acoustically transparent stator, offering many advantages over prior art stator members which often dampened the emitted sonic output.

One of the important design criteria arising from these observations is that the open cavity sector or unclamped portion of the emitter film (i) large enough to allow desired diaphragm or film movement to obtain resonant low frequencies and (ii) but not too large to result in loss of the fringe charge such that it is unable to reach across the cavity opening with significant force. The range of diameter may extend from several micrometers for ultrasonic frequencies, to several centimeters for lower audio output.

The cavities or voids within the foam perform numerous important functions. In addition to modification of physical properties of the polymer matrix by changes in void sizes and shapes, with corresponding changes in wall thickness of surrounding material, the presence of such voids within an electrostatic field develops several electrical effects. One of the most significant effects is the field strength function, which is dependent upon the depth of the cavity from the emitter membrane. For higher frequencies toward the ultrasonic region, the depths may be in micrometers, whereas audio frequencies would fall with the millimeter range. Selection of cavity size will therefore depend upon the frequency output desired and sound quality needed. This factor will be optimized by those skilled in the art with each unique application. Such applications include direct audio production, as well as signal input with a carrier wave and sideband sonic signal.

In addition to direct audio propagation, the present invention has utility in parametric speaker applications where the emitted compression waves are within the ultrasonic region. Here, the foam structure includes a closed cell composition for blocking air transmission between the respective forward and rearward faces. This system involves use of a sideband audio signal mixed with the ultrasonic carrier. The audio signal is then decoupled in surrounding air in accordance with acoustic heterodyning principles.

The thickness of the foam stator may vary widely, depending upon the degree of stiffness required, and void sizing. A preferred range would extend from several millimeters to several centimeters. The foam member may also be formed of at least two different foam compositions integrally coupled together to form the forward face, intermediate section and rear face. This permits use of different foam compositions to provide different levels of stiffness within the foam member. Foam members having different modulus of elasticity values can be combined to affect both structural support and resonant frequency response. The approximate range of modulus values will be determined by the skilled artisan for each application, but will generally be in the range of current conductive foam compositions.

The modulus or stiffness of the foam member may also be modified to enable differential contact of the emitter membrane across the face of the foam member. For example, in addition to continuous contact across the total forward face of the foam member, the device can be configured to develop the direct contact with the contacting edges around a central section of the forward face. The intermediate potion of film can thereby be displaced from the central section of the forward face of the foam member during operation to provide enhanced low frequency response.

An additional embodiment of this invention provides push-pull operation and is illustrated in FIG. 6. It includes a first foam member 59, second foam member 60 having a forward face 61, an intermediate core section 62 and a rear face 63. The forward face of the second foam member (referred to as the second forward face) is positioned on an opposing side of the electrostatic emitter film 65 from the first foam member. The second forward face is composed of a composition having sufficient stiffness to support the electrostatic film and including conductive properties which enable application of the variable voltage to the second forward face to supply the desired sonic signal. The second forward face comprising a surface including small cavities as discussed above, having surrounding wall structure defining each cavity, said surrounding wall structure terminating at contacting edges approximately coincident with the forward face of the foam member. Film application means (not shown) for applying the electrostatic film to the forward face of the second foam member would follow the format as with the single-end embodiment above. As above, biasing means are coupled to the second foam member for biasing the film in direct contact with the contacting edges of the second forward face such that the film is directly supported by the second forward face. The signal source is also applied to the second forward face with the variable voltage which includes the sonic signal. The electrostatic emitter film 65 needs to include a conductive layer in noncontacting relationship with the respective first and second foam members for enabling the film to capacitively respond with the first and second forward faces to the variable voltage in a push-pull relationship. An insulating member 66 may be required with respect to the second foam member.

Figure 7:
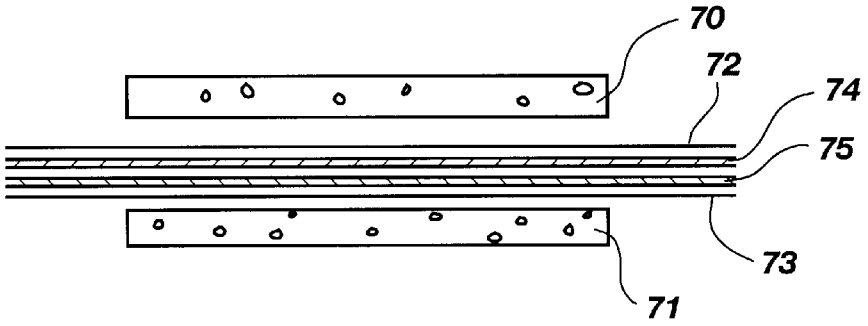
FIG. 7 illustrates a further embodiment of the present invention wherein the film member is sandwiched between opposing foam stators.

Several configurations of the emitter film are possible. For example, FIG. 7 shows first and second foam members 70 and 71 which sandwich the film member. In this case, the electrostatic emitter film comprises at least two sheets 72 and 73 of nonconductive emitter film which respectively include a conductive surface 74 and 75. The nonconductive emitter film provides insulation between the conductive layer and the respective first and second forward faces.

Figure 8:
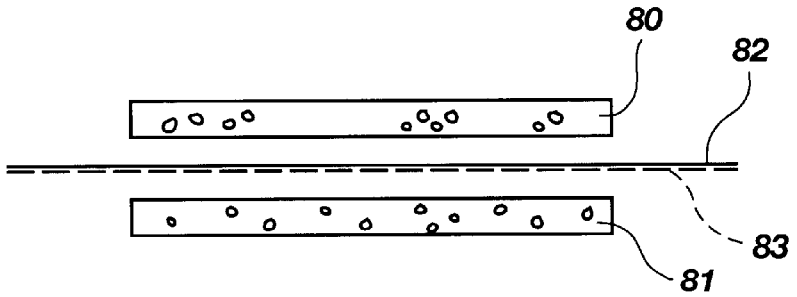
FIG. 8 shows a further embodiment of the present invention having a single film member.

The respective conductive surfaces 74 and 75 are bonded together to form an integral conductive layer. Alternatively, a single film element can be used as illustrated in FIG. 8, wherein the respective first and second foam members operate in push-pull configuration with respect to a conductive coating 83, on the film element 82.

Figure 9:
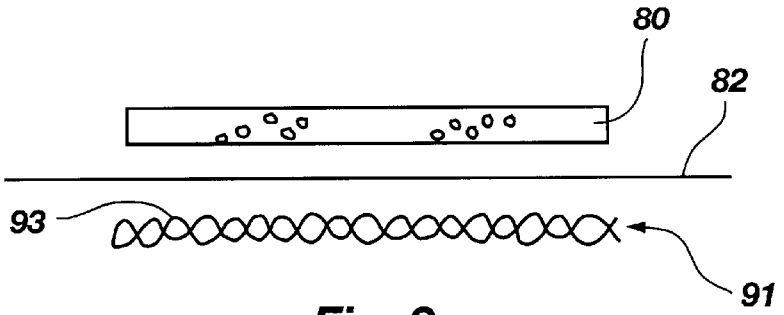
FIG. 9 depicts an additional embodiment including an expanded metal stator.

FIG. 9 shows an alternate embodiment where the second foam member is replaced with an expanded metal stator 91. In this case, the conductive nature of the metal stator requires a coating of insulative material on the proximate side of the film 82, or on the forward face 93 of the metal stator. Other configurations where various stator combinations from prior art electrostatic emitters may also be envisioned.

Figure 10:
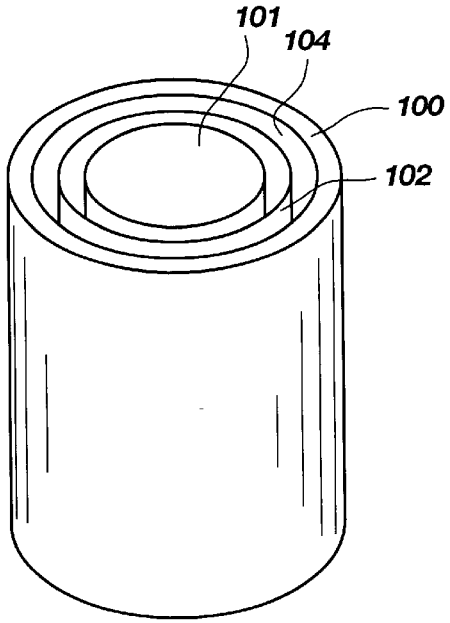
FIG. 10 graphically represents an additional cylindrical embodiment of the present invention.

Similarly, the polarity and insulative sides of the foam members may be reversed so that the forward face of the foam is insulated, and the emitter film contacting face is conductive. Such a device is illustrated in FIG. 10 as a cylindrical speaker. The device comprises an electrostatic emitter film 102 which is responsive to an applied variable voltage to emit sonic output based on a desired sonic signal. A first foam member 100 having a forward face, an intermediate core section and a rear face as described above is positioned on the exterior and includes open cell structure to transmit sound. The first foam member including a composition having sufficient stiffness to support the electrostatic film and including conductive properties which enable application of a variable voltage to supply the desired sonic signal. The first forward face 104 comprises a surface including small cavities having surrounding wall structure defining each cavity, the surrounding wall structure terminating at contacting edges approximately coincident with the forward face of the foam member. This forward face 104 has a coating of insulative material to prevent arcing from the voltage within the intermediate foam section and the film 102. A second foam member 101 of comparable configuration in opposing orientations is provided to complement the push-pull construction. This foam may be partial open cell and partial closed cell to dampen rearward sound transmission. An insulation barrier be provided on an adjacent side of the film (metalized surface), or at the second forward face of the stator 101. Sound propagation would therefore be oriented radiated outward from the cylinder, reinforced by the dynamic affect of both stator elements. Insulating means is positioned between the electrostatic emitter film and the conductive composition of the first foam member which has the conducive properties.

Figure 11:
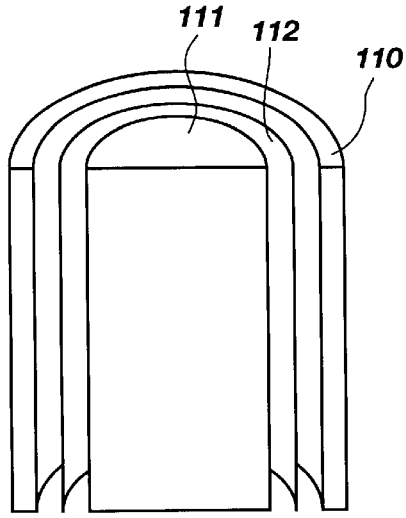
FIG. 11 provides a diagonal cross-section of another embodiment of FIG. 10, taken along the central axis of the cylinder.

A variation of the foam member would be a more general support member as shown in FIG. 11. In this embodiment, the device includes an electrostatic emitter film 112 responsive to a variable voltage to emit sonic output based on a desired sonic signal. A support member 110 having a forward face, an intermediate core section and a rear face is formed of a conductive material which includes a forward face composed of a composition having sufficient stiffness to support the electrostatic film and including conductive properties which enable application of a variable voltage to the forward face to supply the desired sonic signal. The forward face comprises a generally pitted surface including small cavities having surrounding wall structure defining each cavity, said surrounding wall structure terminating at a contacting edges approximately coincident with the forward face of the support member. This may be in the form of a metal or expanded metal material which operates in a manner similar to the foam structure. Hereagain, the conductive and insulative surfaces could be reversed as explained above. A push-pull configuration is provided by the second support member 111.

Figure 12:
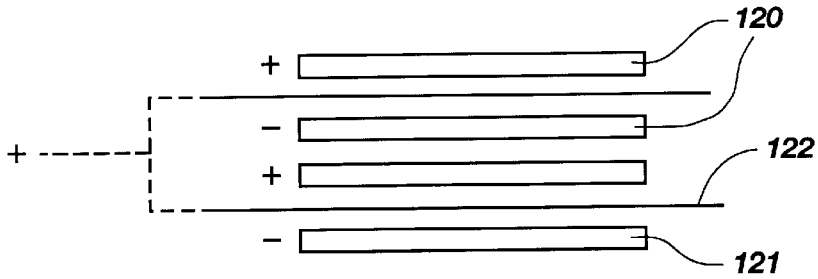
FIGS. 12 and 13 graphically depict multiple film embodiments of the present invention.
Figure 13:
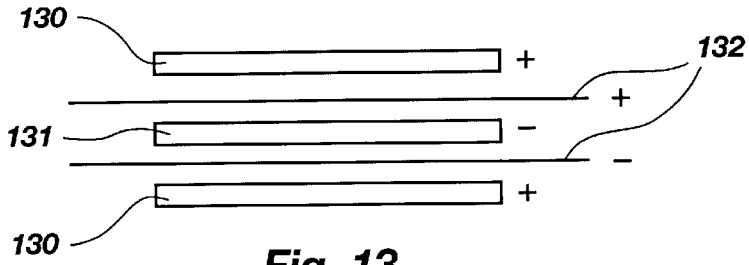

FIGS. 12 and 13 illustrate the use of multiple emitter films 122 and 132, sandwiched between foam or general support members 120, 121, 130, 131. Each additional emitter film mill add approximately 3 db output to the emitted sonic signal. It will be apparent that numerous configurations can be adapted within this multiple combination pattern.

These preferred embodiment are generally represented by a method of generating sonic out put as suggested in the following steps:

a) selecting a foam member having a forward face small cavities defined by surrounding wall structure which includes conductive properties enabling application of a variable voltage to the forward face to supply the desired sonic signal;

b) applying to the forward face of the foam member an electrostatic emitter film which is responsive to the applied variable voltage to emit sonic output based on the desired sonic signal;

c) biasing the film with respect to the forward face such that the film is responsive to the variable voltage of the foam member as an electrostatic emitter;

d) supplying the variable voltage to the combination of foam member and emitter; and e) propagating sonic compression waves from the emitter into surrounding air.

Figure 14:
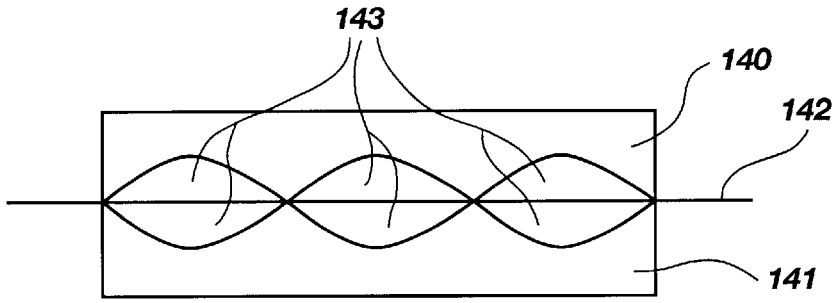
FIGS. 14, 15 and 16 illustrate additional arcuate shapes suitable for the present invention.
Figure 15:
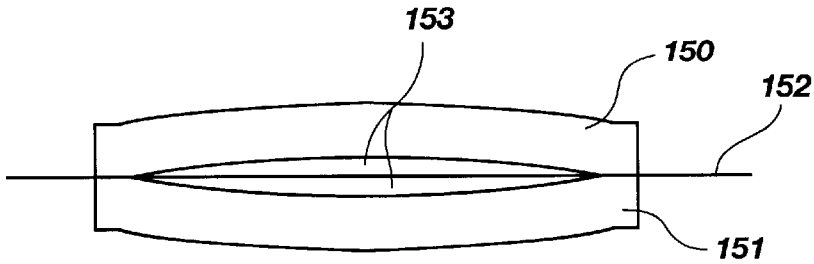
Figure 16:
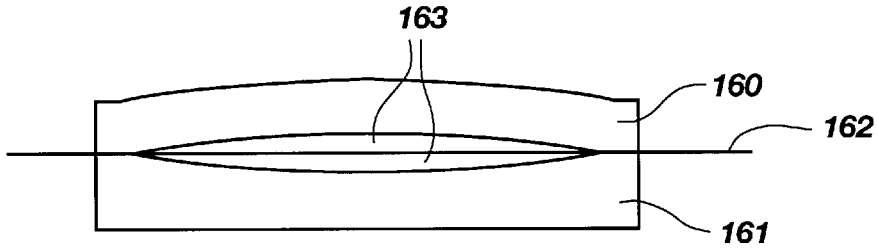

Other variation of apparatus and methodology will be apparent from the following claims. For example, FIGS. 14, 15 and 16 show opposing foam stators 140, 141, 150, 151, 160, 161 positioned around an emitter film 142, 152, 162. Central portions of the respective forward faces are concave to permit greater movement of the film from the stators. This is significant for operation at lower frequencies. Resulting cavities 143, 153, 163 enable greater displacement. Otherwise, the construction is similar to mounting procedures set forth above.

What is claimed is:

1. A speaker device comprising:

an electrostatic emitter film which is responsive to an applied variable voltage to emit sonic output based on a desired sonic signal;

a first foam member having a forward face, an intermediate core section, and a rear face which includes a nonporous member for blocking unimpeded sound transmission;

at least said forward face being composed of a composition having sufficient stiffness to support the electrostatic film and including conductive properties which enable application of a variable voltage to the forward face to supply the desired sonic signal;

said forward face comprising a surface including small cavities having surrounding wall structure defining each cavity, said surrounding wall structure terminating at contacting edges approximately coincident with the forward face of the foam member;

film application means for applying the electrostatic film to the forward face of the foam member;

biasing means for biasing the film in direct contact with the contacting edges of the forward face such that the film is directly supported by the forward face; and coupling means for coupling a signal source to the speaker device for supplying the variable voltage which includes a sonic signal.

2. A speaker device comprising:

an electrostatic emitter film which is responsive to an applied variable voltage to emit sonic output based on a desired sonic signal;

a first foam member having a forward face, an intermediate core section, and a rear face;

at least said forward face being composed of a composition having sufficient stiffness to support the electrostatic film and including conductive properties which enable application of a variable voltage to the forward face to supply the desired sonic signal;

said forward face comprising a surface including small cavities having surrounding wall structure defining each cavity, said surrounding wall structure terminating at contacting edges approximately coincident with the forward face of the foam member;

film application means for applying the electrostatic film to the forward face of the foam member;

biasing means for biasing the film in direct contact with the contacting edges of the forward face such that the film is directly supported by the forward face;

coupling means for coupling a signal source to the speaker device for supplying the variable voltage which includes a sonic signal;

a second foam member having a forward face, an intermediate core section and a rear face, said forward face of the second foam member (referred to as the second forward face) being positioned on an opposing side of the electrostatic emitter film from the first foam member;

said second forward face being composed of a composition having sufficient stiffness to support the electrostatic film and including conductive properties which enable application of the variable voltage to the second forward face to supply the desired sonic signal;

said second forward face comprising a surface including small cavities having surrounding wall structure defining each cavity, said surrounding wall structure terminating at contacting edges approximately coincident with the forward face of the foam member;

film application means for applying the electrostatic film to the forward face of the second foam member;

said biasing means being coupled to the second foam member for biasing the film in direct contact with the contacting edges of the second forward face such that the film is directly supported by the second forward face;

said coupling means including means for coupling the signal source to the second forward face with the variable voltage which includes the sonic signal; and said electrostatic emitter film including a conductive layer in non-contacting relationship with the respective first and second foam members for enabling the film to capacitively respond with the first and second forward faces to the variable voltage in a push-pull relationship.

3. A device as defined in claim 2, wherein the second foam member comprises a single foam composition forming the respective second forward face, intermediate core section and rear face.

4. A device as defined in claim 2, wherein the foam composition is selected from the group of materials consisting of foamable polymers.

5. A device as defined in claim 2, wherein the foam member comprises an open cell structure.

6. A device as defined in claim 2, wherein the open cell structure extends from the second forward face to the rear face, allowing air to pass between the respective faces for transmitting sonic output from the emitter film in forward and rearward directions.

7. A device as defined in claim 2, wherein said film is composed of a substantially nonconductive polymer composition.

8. A device as defined in claim 2, wherein said emitter film comprises a conductive intermediate layer having nonconductive exposed layers on opposing sides of the intermediate layer.

9. A device as defined in claim 2, wherein the conductive intermediate layer comprises a thin metallic film coated with nonconductive exposed layers on opposing sides of the intermediate layer.

10. A device as defined in claim 2, wherein the electrostatic emitter film comprises at least two sheets of nonconductive emitter film which respectively include a conductive surface, said respective conductive surfaces being in contact to form the conductive layer, said nonconductive emitter film providing insulation between the conductive layer and the respective first and second forward faces.

11. A device as defined in claim 10, wherein the respective conductive surfaces are bonded together to form an integral conductive layer.

12. A speaker device comprising:

an electrostatic emitter film which is responsive to an applied variable voltage to emit sonic output based on a desired sonic signal;

a first foam member having a forward face, an intermediate core section and a rear face;

said first foam member including a composition having sufficient stiffness to support the electrostatic film and including conductive properties which enable application of a variable voltage to supply the desired sonic signal;

said forward face comprising a surface including small cavities having surrounding wall structure defining each cavity, said surrounding wall structure terminating at contacting edges approximately coincident with the forward face of the foam member;

film application means for applying the electrostatic film to the forward face of the foam member;

insulating means comprises the forward face and the intermediate core section which includes conductive properties;

biasing means for biasing the film in direct contact with the contacting edges of the forward face such that the film is directly supported by the forward face; and coupling means for coupling a signal source to the speaker device for supplying the variable voltage which includes a sonic signal.

13. A device as defined in claim 12, further comprising:

a second foam member having a forward face, an intermediate core section and a rear face, said forward face of the second foam member (referred to as the second forward face) being positioned on an opposing side of the electrostatic emitter film from the first foam member;

said second foam member being composed of a composition having sufficient stiffness to support the electrostatic film and including conductive properties which enable application of the variable voltage to supply the desired sonic signal;

said second forward face comprising a surface including small cavities having surrounding wall structure defining each cavity, said surrounding wall structure terminating at contacting edges approximately coincident with the forward face of the foam member;

film application means for applying the electrostatic film to the forward face of the second foam member;

said biasing means being coupled to the second foam member for biasing the film in direct contact with the contacting edges of the second forward face such that the film is directly supported by the second forward face;

said coupling means including means for coupling the signal source to the second foam member with the variable voltage which includes the sonic signal.

14. A device as defined in claim 13, wherein the electrostatic emitter film comprises a conductive layer biased in contacting relationship with the respective first and second foam members for enabling the film to capacitively respond with the first and second forward faces to the variable voltage in a push-pull relationship.

15. An ultrasonic speaker device, comprising:

an electrostatic emitter film which is responsive to an applied variable voltage to emit ultrasonic output;

a first foam member having a forward face, an intermediate core section and a rear face including a nonporous member for blocking unimpeded ultrasonic wave transmission;

at least said forward face being composed of a composition having sufficient stiffness to support the electrostatic film and including conductive properties which enable application of a variable voltage to the forward face to supply the desired ultrasonic signal;

said forward face comprising a surface including small cavities having surrounding wall structure defining each cavity, said surrounding wall structure terminating at contacting edges approximately coincident with the forward face of the foam member;

film application means for applying the electrostatic film to the forward face of the foam member;

biasing means for biasing the film in direct contact with the contacting edges of the forward face such that the film is directly supported by the forward face; and coupling means for coupling an ultrasonic signal source to the speaker device for supplying the variable voltage which includes a sonic signal.

16. An ultrasonic speaker device, comprising:

an electrostatic emitter film which is responsive to an applied variable voltage to emit ultrasonic output;

a first foam member having a forward face, an intermediate core section and a rear face;

at least said forward face being composed of a composition having sufficient stiffness to support the electrostatic film and including conductive properties which enable application of a variable voltage to the forward face to supply the desired ultrasonic signal;

said forward face comprising a surface including small cavities having surrounding wall structure defining each cavity, said surrounding wall structure terminating at contacting edges approximately coincident with the forward face of the foam member;

film application means for applying the electrostatic film to the forward face of the foam member;

biasing means for biasing the film in direct contact with the contacting edges of the forward face such that the film is directly supported by the forward face; and coupling means for coupling an ultrasonic signal source to the speaker device for supplying the variable voltage which includes a sonic signal;

a second foam member having a forward face, an intermediate core section and a rear face, said forward face of the second foam member (referred to as the second forward face) being positioned on an opposing side of the electrostatic emitter film from the first foam member;

said second forward face being composed of a composition having sufficient stiffness to support the electrostatic film and including conductive properties which enable application of the variable voltage to the second forward face to supply the desired ultrasonic signal;

said second forward face comprising a surface including small cavities having surrounding wall structure defining each cavity, said surrounding wall structure terminating at contacting edges approximately coincident with the forward face of the foam member;

film application means for applying the electrostatic film to the forward face of the second foam member;

said biasing means being coupled to the second foam member for biasing the film in direct contact with the contacting edges of the second forward face such that the film is directly supported by the second forward face;

said coupling means including means for coupling the ultrasonic signal source to the second forward face with the variable voltage which includes the ultrasonic signal mixed with the sideband audio signal;

said electrostatic emitter film including a conductive layer in non-contacting relationship with the respective first and second foam members for enabling the film to capacitively respond with the first and second forward faces to the variable voltage in a push-pull relationship.

17. A device as defined in claim 16, wherein said emitter film comprises a conductive intermediate layer having nonconductive exposed layers on opposing sides of the intermediate layer.

18. A device as defined in claim 16, wherein the electrostatic emitter film comprises at least two sheets of nonconductive emitter film which respectively include a conductive surface, said respective conductive surfaces being in contact to form the conductive layer, said nonconductive emitter film providing insulation between the conductive layer and the respective first and second forward faces.

19. A device as defined in claim 16, wherein the respective conductive surfaces are bonded together to form an integral conductive layer.

20. A speaker device comprising:

an electrostatic emitter film which is responsive to an applied variable voltage to emit ultrasonic output based on an audio signal sideband signal mixed with an ultrasonic carrier;

a first foam member having a forward face, an intermediate core section and a rear face;

said first foam member including a composition having sufficient stiffness to support the electrostatic film and including conductive properties which enable application of a variable voltage to supply a desired ultrasonic signal;

said forward face comprising a surface including small cavities having surrounding wall structure defining each cavity, said surrounding wall structure terminating at contacting edges approximately coincident with the forward face of the foam member;

film application means for applying the electrostatic film to the forward face of the foam member;

insulating means positioned between the electrostatic emitter film and the conductive composition of the first foam member which has the conductive properties;

biasing means for biasing the film in direct contact with the contacting edges of the forward face such that the film is directly supported by the forward face; and coupling means for coupling an ultrasonic signal source to the speaker device for supplying the variable voltage which includes an audio signal mixed with an ultrasonic carrier;

a second foam member having a forward face, an intermediate core section and a rear face, said forward face of the second foam member (referred to as the second forward face) being positioned on an opposing side of the electrostatic emitter film from the first foam member;

said second foam member being composed of a composition having sufficient stiffness to support the electrostatic film and including conductive properties which enable application of the variable voltage to supply the desired ultrasonic signal;

said second forward face comprising a surface including small cavities having surrounding wall structure defining each cavity, said surrounding wall structure terminating at contacting edges approximately coincident with the forward face of the foam member;

film application means for applying the electrostatic film to the forward face of the second foam member;

said biasing means being coupled to the second foam member for biasing the film in direct contact with the contacting edges of the second forward face such that the film is directly supported by the second forward face;

said coupling means including means for coupling the ultrasonic signal source to the second foam member with the variable voltage which includes an ultrasonic carrier signal modulated with audio sideband signals.

21. A speaker device, comprising:

a first support member having a forward face, an intermediate core section and a rear face;

said first support member including a composition having sufficient stiffness to support the electrostatic film and including conductive properties which enable application of a variable voltage to supply an ultrasonic;

said forward face comprising a surface including small cavities having surrounding wall structure defining each cavity, said surrounding wall structure terminating at contacting edges approximately coincident with the forward face of the first support member;

film application means for applying the electrostatic film to the forward face of the first support member;

insulating means positioned between the electrostatic emitter film and the conductive composition of the first support member which has the conductive properties;

biasing means for biasing the film in direct contact with the contacting edges of the forward face such that the film is directly supported by the forward face;

a second support member having a forward face, an intermediate core section and a rear face, said forward face of the second support member (referred to as the second forward face) being positioned on an opposing side of the electrostatic emitter film from the first support member;

said second support member being composed of a composition having sufficient stiffness to support the electrostatic film and including conductive properties which enable application of the variable voltage to supply a desired ultrasonic output;

said second forward face comprising a surface including small cavities having surrounding wall structure defining each cavity, said surrounding wall structure terminating at contacting edges approximately coincident with the forward face of the second support member;

film application means for applying the electrostatic film to the forward face of the second support member;

said biasing means being coupled to the second support member for biasing the film in direct contact with the contacting edges of the second forward face such that the film is directly supported by the second forward face;

coupling means for coupling an ultrasonic signal source to the first and second support members with the variable voltage which includes an audio sideband signal mixed with an ultrasonic carrier signal to be decoupled in surrounding air according to acoustic heterodyning principles.

22. A device as defined in claim 21, wherein the electrostatic emitter film comprises a conductive layer biased in contacting relationship with the respective first and second support members for enabling the film to capacitively respond with the first and second forward faces to the variable voltage in a push-pull relationship.

* * * * *